US009653825B2

(12) United States Patent
Courchaine et al.

(10) Patent No.: US 9,653,825 B2
(45) Date of Patent: May 16, 2017

(54) MODIFIED REGISTERED JACK-STYLE PLUG FOR DIRECT ATTACHMENT TO A CIRCUIT BOARD

(71) Applicant: AFL Telecommunications LLC, Duncan, SC (US)

(72) Inventors: Wilfred J. Courchaine, Moore, SC (US); Roger Vaughn, Greer, SC (US)

(73) Assignee: AFL Telecommunications LLC, Duncan, SC (US)

( * ) Notice: Subject to any disclaimer, the term of this patent is extended or adjusted under 35 U.S.C. 154(b) by 172 days.

(21) Appl. No.: 14/414,256

(22) PCT Filed: Sep. 3, 2014

(86) PCT No.: PCT/US2014/053796
§ 371 (c)(1),
(2) Date: Jan. 12, 2015

(87) PCT Pub. No.: WO2015/034869
PCT Pub. Date: Mar. 12, 2015

(65) Prior Publication Data

US 2016/0285181 A1 Sep. 29, 2016

Related U.S. Application Data

(60) Provisional application No. 61/873,258, filed on Sep. 3, 2013.

(51) Int. Cl.
*H01R 13/60* (2006.01)
*H01R 12/51* (2011.01)
(Continued)

(52) U.S. Cl.
CPC ..... *H01R 12/51* (2013.01); *H01R 12/58* (2013.01); *H01R 24/64* (2013.01); *H01R 12/7064* (2013.01)

(58) Field of Classification Search
CPC ..... F21V 21/08
(Continued)

(56) References Cited

U.S. PATENT DOCUMENTS 5,096,439 A * 3/1992 Arnett ..... H01R 13/741 174/66
6,474,999 B1 11/2002 Givens et al.
(Continued)

FOREIGN PATENT DOCUMENTS

CN 202004172 U 10/2011

OTHER PUBLICATIONS

International Search Report for PCT/US2014/053796 dated Dec. 17, 2014.
Written Opinion for PCT/US2014/053796 dated Dec. 17, 2014.

*Primary Examiner* — Phuong Dinh
(74) *Attorney, Agent, or Firm* — Dority & Manning, P.A.

(57) ABSTRACT

A physical network plug, configured to attach to a registered jack (RJ)-style jack and also configured to be directly mountable to a circuit board, is provided. The plug includes a plurality of pin contacts extending from a front end thereof and configured to extend through and be electrically connected to a circuit board. Each of the pin contacts is electrically connected to a spade disposed within the plug. The plug further includes a pair of tabs, extending from the front end of the plug, and configured to extend through the circuit board from a rear side to a front side of the circuit board, and to clasp the front side of the circuit board.

8 Claims, 9 Drawing Sheets

(51) Int. Cl.
*H01R 12/58* (2011.01)
*H01R 24/64* (2011.01)
*H01R 12/70* (2011.01)

(58) Field of Classification Search
USPC ..... 439/576, 76.1, 83
See application file for complete search history.

(56) References Cited

U.S. PATENT DOCUMENTS

| | | | | |
|---|---|---|---|---|
| 7,322,860 | B2 | 1/2008 | Martich et al. | |
| 8,467,654 | B2 * | 6/2013 | Su | G02B 6/3817 385/139 |
| 2005/0078819 | A1 | 4/2005 | Hsu et al. | |
| 2011/0092100 | A1 | 4/2011 | Coffey et al. | |

* cited by examiner

MODIFIED REGISTERED JACK-STYLE PLUG FOR DIRECT ATTACHMENT TO A CIRCUIT BOARD

CROSS-REFERENCE TO RELATED APPLICATION

This application is based upon and claims the benefit of priority from U.S. Provisional Application No. 61/873,258, filed Sep. 3, 2013 in the United States Patent and Trademark Office, the disclosure of which is incorporated herein in its entirety by reference.

BACKGROUND

1. Field

Apparatuses consistent with exemplary embodiments relate to a plug, configured to attach to a registered jack (RJ)-style jack and also configured to be directly mountable to a circuit board and to a unified apparatus comprising a board and the plug directly mounted thereto.

2. Related Art

An RJ is a standard physical network interface for connecting telecommunications or data equipment to a service provider via a local exchange carrier or a long distance carrier. RJs are commonly used on, or in conjunction with, printed circuit boards (PCBs) to provide a connection point for telephony or data delivery products. Plugs for RJs are available for crimping to satin wire (also called satin cable) regular two pair, three pair, or four pair 22-26 American Wire Gauge (AWG) telecommunication wiring. However, plugs for direct mounting an RJ to a PCB are nonexistent.

PCB mounted RJ plugs are necessary when attaching certain filters or other telecommunication-related items directly to a jack, a wall mount, or other style of mounting. However, currently-available RJ plugs must be adapted for use in such a manner, and the result is often a weak connection to the PCB which cannot be held securely for plugging and unplugging, is impractical, and prone to failure.

SUMMARY

Exemplary embodiments may address at least the above problems and/or disadvantages and other disadvantages not described above.

One or more exemplary embodiments may provide an plug which is configured to attach to an RJ and also configured to be directly mountable to a circuit board, such as a PCB. The plug may be extended in length as compared to a standard RJ plug, to allow for surfaces such as a cover plate to be mounted between the circuit board and a jack, and which facilitates the construction of an enclosure around the device containing the circuit board.

The plug may be configured to include securing features, as well as pin contacts that can be soldered in place, to provide a robust attachment to a circuit board.

The plug may include a board interface, which is not configured to be attached to a wire or cable, but which is expanded in size, as compared to a standard RJ plug, to provide a configuration by which to secure the plug to a circuit board, The board interface may also be configured to be attached to a cover plate. The plug may further include additional features, such as protrusions, steps, snaps, and the like, that can be used for further securing the plug.

BRIEF DESCRIPTION OF THE DRAWING

These and/or other exemplary aspects and advantages will become apparent and more readily appreciated from the following description of exemplary embodiments, taken in conjunction with the accompanying drawings in which.

DETAILED DESCRIPTION

The following detailed description is provided to assist the reader in gaining a comprehensive understanding of the methods, apparatuses and/or systems described herein. Various changes, modifications, and equivalents of the systems, apparatuses and/or methods described herein will suggest themselves to those of ordinary skill in the art. Descriptions of well-known functions and structures are omitted to enhance clarity and conciseness.

The terms used in the description are intended to describe embodiments only, and shall by no means be restrictive. Unless clearly used otherwise, expressions in a singular form include a meaning of a plural form. In the present description, an expression such as "comprising" or "including" is intended to designate a characteristic, a number, a step, an operation, an element, a part or combinations thereof, and shall not be construed to preclude any presence or possibility of one or more other characteristics, numbers, steps, operations, elements, parts or combinations thereof.

Figure 1:
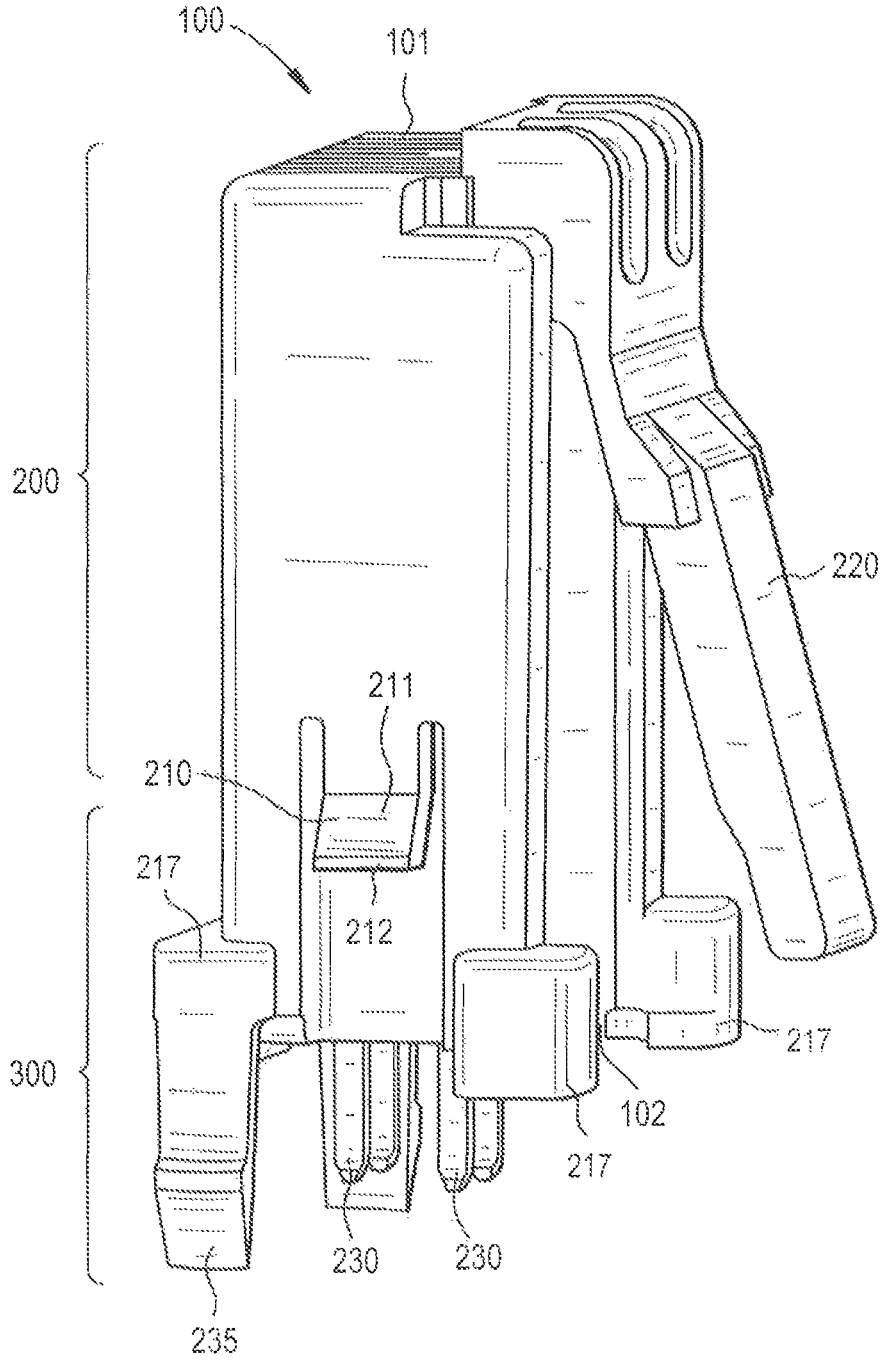
FIG. 1 illustrates a plug configured to be directly mounted to a circuit board, according to an exemplary embodiment.
Figure 2A:
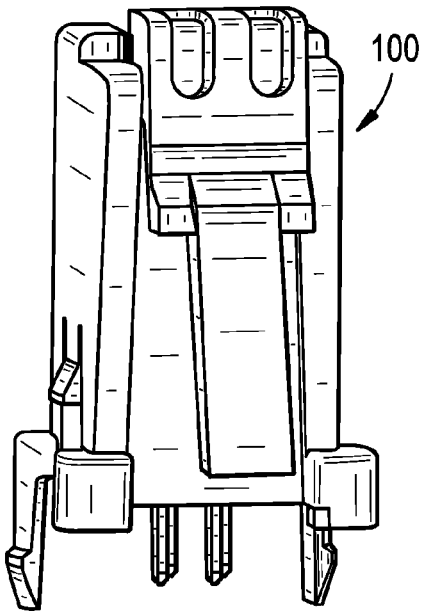
FIGS. 2A, 2B, and 2C are perspective views of the plug shown in FIG. 1.
Figure 2B:
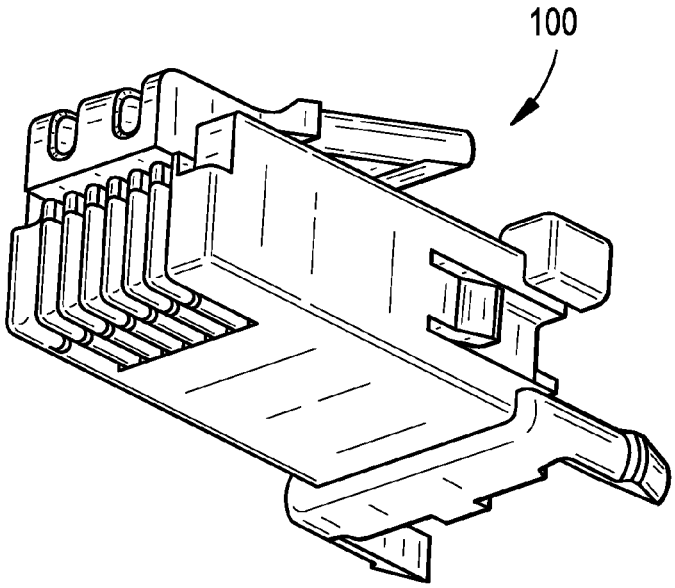
Figure 2C:
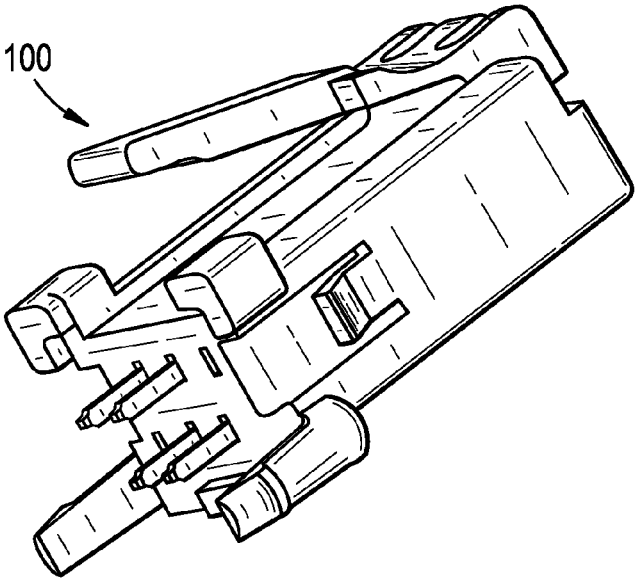

FIG. 1 illustrates a plug configured to be connectable to a standard RJ jacks and to be directly mounted to a circuit board such as a Printed Circuit Board (PCB), according to an exemplary embodiment. FIGS. 2A, 2B, and 2C provide additional perspective views of the plug 100. An outer main body 150 of the plug 100 may be made of any plastic material that is formed or molded, such as polyolefin, nylon, polycarbonate, etc. The plug 100 is extended in a length direction, as compared to a conventional RJ plug, and includes a mounting interface 200 and a board interface 300. The mounting interface is at least as long as necessary to connect to a conventional RJ-style jack or a special-depth jack. Plug interface dimensions are per International Organization for Standardization (ISO) standard 8877. The mounting interface 200 is distinct from that of a conventional RJ plug, but, like a conventional RJ plug, the mounting interface 200 is configured to be connectable to a conventional RJ jack. The board interface 300 is configured to be directly mountable to a circuit board 500 and cover plate 600 (see FIGS. 5A and 7A) and soldered, or otherwise electrically connected to the circuit board 500.

The mounting interface 200 includes a rear end 101 of the plug which is configured to be connectable to a conventional RJ jack, per ISO standard 8877, and includes the industry-standard features which enable it to be attachable by plugging into a conventional RJ-style jack, as would be understood by one of skill in the art. Additionally, the mounting interface may include snaps 210 provided on opposite sides of the plug 100. A single pair of snaps 210 is shown in the figures, with a single snap 210 disposed on each of opposite sides of the plug 100. However, the plug may include any number of one or more snaps as would be understood by one of skill in the art. The snaps 210 may be made of the same material as the main body 150 of the plug, and may be integrally formed therewith. The snaps 210 extend outwardly from the sides of the plug 100 and may have a tapered shape, as shown, so that as the plug is inserted into an opening in a cover plate 600, as discussed in more detail below, the inner edge of an opening in the cover plate may slide along the outer, tapered sides 211 of the snaps 210 and may then snap to the sides of the plug 100 adjacent to the front edge 212 of the snaps 210. As discussed in further detail below, an engagement between the snaps 210 and a cover plate 600 helps to provide stability for a connection between the plug 100 and the circuit board 500, and aids in securing the cover plate 600 to the circuit board 500.

The mounting interface may also include a snap release 220, similar to that on a conventional RJ plug, as would be understood by one of skill in the art, which securely connects the plug 100 to an RJ jack and enables the release of the plug 100 therefrom. The snap release 220 may be formed of the same material as the plug main body 150 and may be integrally formed therewith.

Figure 5A:
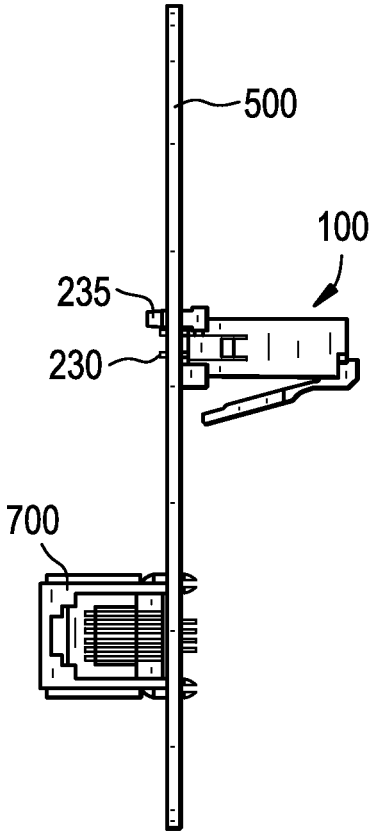
FIGS. 5A and 5B are a side view and an end view, respectively, of a plug attached to a circuit board, according to an exemplary embodiment.
Figure 5B:
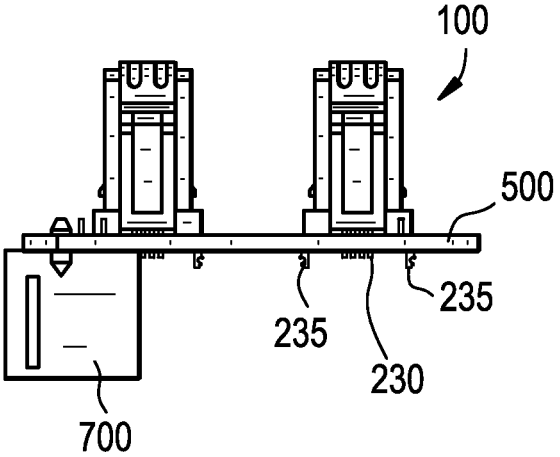

The board interface 300 is specially configured to enable the plug 100 to be directly mounted to a circuit board 500, such as a PCB. As shown in FIGS. 5A and 5B, the plug 100 is designed to extend through an opening in a circuit board 500 and attach to a front 551 of the circuit board 500 by means of one or more electrically-conductive conductive pin contacts 230, which extend through the circuit board 500 from the rear side 552 to the front side 551 of the circuit board, and tabs 235 which also extend through from the rear side 552 to the front side 551 of the circuit board 500 to secure the plug 100 to the circuit board 500.

Figure 3:
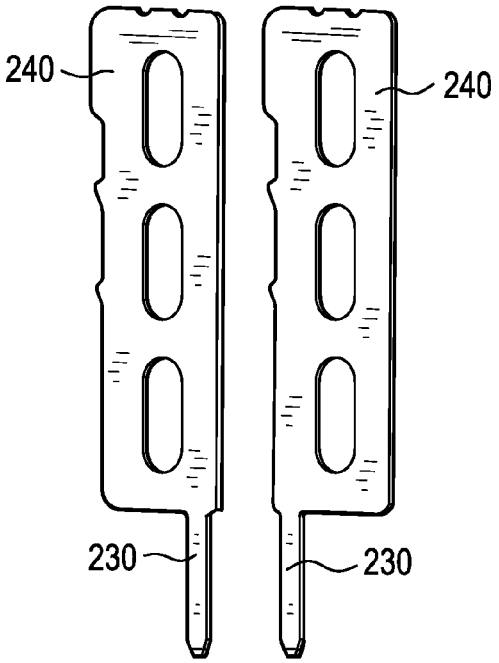
FIG. 3 illustrates two spades of the plug, according to an exemplary embodiment.
Figure 4:
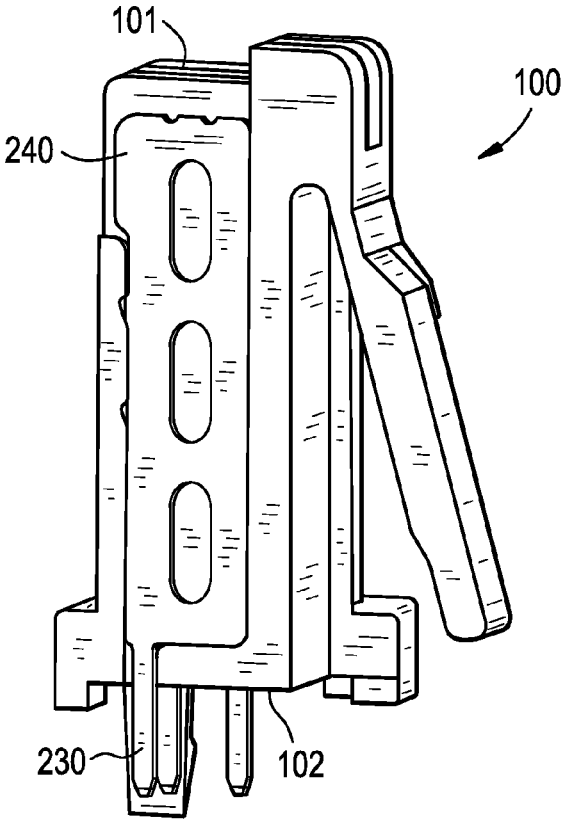
FIG. 4 is a perspective view of an open plug showing the spades therein, according to an exemplary embodiment.

The pin contacts 230 extend outwardly, substantially parallel to one another, from the front end 102 of the plug, and are each part of a larger spade 240. The plug may include four or six pin contacts 230, corresponding to four or six spades 240, as is common in conventional RJ plugs, or may include more or fewer pin contacts 230 and corresponding spades 240, as would be understood by one of skill in the art. The pin contacts 230 and spades 240 may be integrally formed with each other of a conductive material, as would be understood by one of skill in the art, for example, brass, copper, bronze, or another suitable contact material. As shown in FIGS. 3 and 4, the spades extend in a lengthwise direction through the plug 100, from the pin contacts 230 at the front end 102 of the plug 100 to the rear end 101 of the plug 100, and form an electrical connection between the pin contacts 230 and an RJ jack to which the rear end 101 of the plug 100 may be connected. The spades 240 may be of any of a variety of different shapes, and, as shown in FIG. 3, the pin contacts 230 may extend from any of various areas of the spades, so long as they are configured to extend out the front end 102 of the plug 100 to be connected to the circuit board 500. The spades 240 may be shaped substantially similarly to those of a conventional RJ plug, but are longer than those of a conventional RJ plug, corresponding to the extended overall length of the plug 100 of the present exemplary embodiment. These spades 240 can be configured to be installable into the form of the plug 100 and also to include the pin contacts 230 conforming to locations on the circuit board for mounting and soldering.

The tabs may be positioned at corners of the front end 102 of the plug 100 and may extend outwardly, substantially parallel to one another, from the front end 102. The tabs may be made of the same material as that of the main body 150 and may be integrally formed therewith. Alternately, the material of the tabs may be thinned to be made more flexible.

The board interface 300 also includes standoffs (or spacers) 217, provided at the front end 102 of the plug 100. The standoffs 217 may be disposed on corners of the front end 102 and may be of the same material as that of the main body 150 and may be formed integrally therewith. A rear end of the tabs 235 may also function as standoffs, as shown in FIG. 1. The standoffs 217 oppose the pair of snaps 210, directly or indirectly, as shown in FIG. 1, such that when the plug 100 is mounted to the cover plate 600, the snaps 210 and the standoffs 217 together grip the cover plate 600 therebetween, as shown in further detail in FIGS. 7A and 7B. The standoffs/spacers 217 can be configured to provide the correct spacing and snap locations needed. Adjustments may be made to the positions and dimensions of the standoffs 217 to take into account various possible thicknesses of the cover plate 600.

Figure 6A:
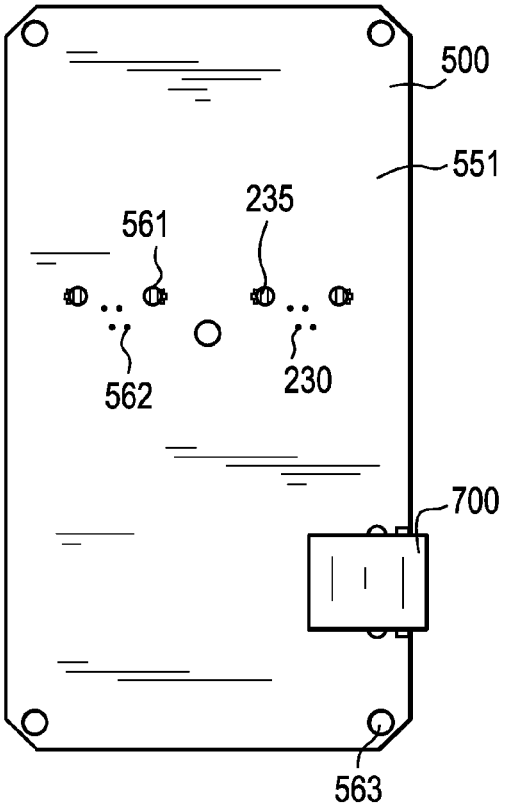
FIGS. 6A and 6B are a front view and a rear view, respectively, of a circuit board to which a plug is attached, according to an exemplary embodiment.
Figure 6B:
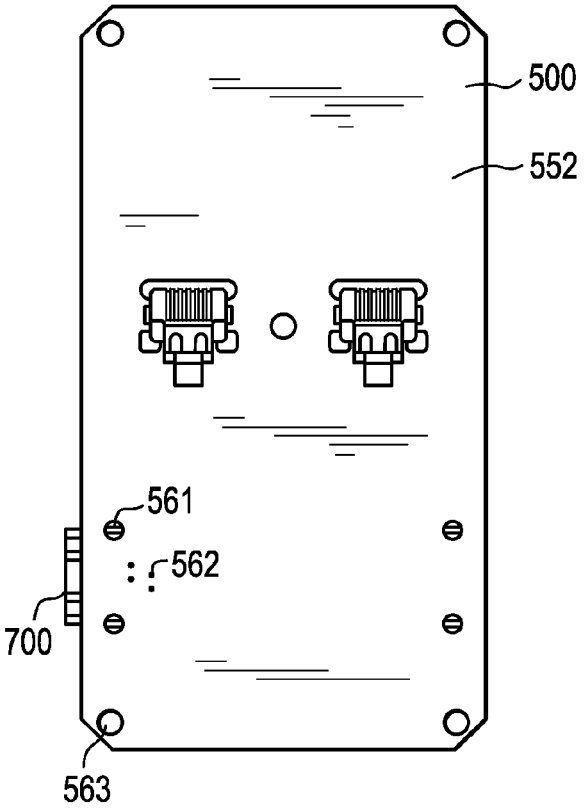

FIGS. 6A and 6B are a front view and a rear view, respectively, of a circuit board 500 to which a plug 100 is attached, according to an exemplary embodiment. FIGS. 5A and 5B illustrate a side view and an end view, respectively, of a plug 100 attached to a circuit board 500. The plug 100 and the snaps 210 and tabs 235 are configured to be connectable to any standard circuit board 500 that includes commonly-used holes 561 and 562 for mounting devices. The circuit board 500 may also include one or more holes 563 for connection to a cover plate 600, as discussed below.

When the plug 100 is connected to the circuit board 500, the tabs 235 and the pin contacts 230 extend through the holes 561 and 562, respectively, of the circuit board 500 from the rear side 552 to the front side 551 of the circuit board 500. Thus, when the plug 100 and circuit board 500 are connected, front ends of the pin contacts 230 are in a position to be soldered or otherwise electrically connected to the front side 551 of the circuit board 500. Another device, for example a jack 700, may also be connected to the circuit board 500. As shown in FIGS. 5A, 5B, 6A, and 6B, the jack 700 may be connected, with pins and tabs similar to those included on the plug 100. However, the jack 700 may be connected to the circuit board 500 with its pins and tabs extending through the circuit board 500 from the front side 551 to the rear side 552 thereof. As discussed in further detail below, the configuration of the plug 100, according an exemplary embodiment, enables the provision of sufficient spacing between the circuit board 500 and a cover plate 600 for the jack 700 or other device to be connected in this manner to the front side 551 of the circuit board 500 while its tabs extend through the circuit board 500 to the rear side 552.

Figure 8A:
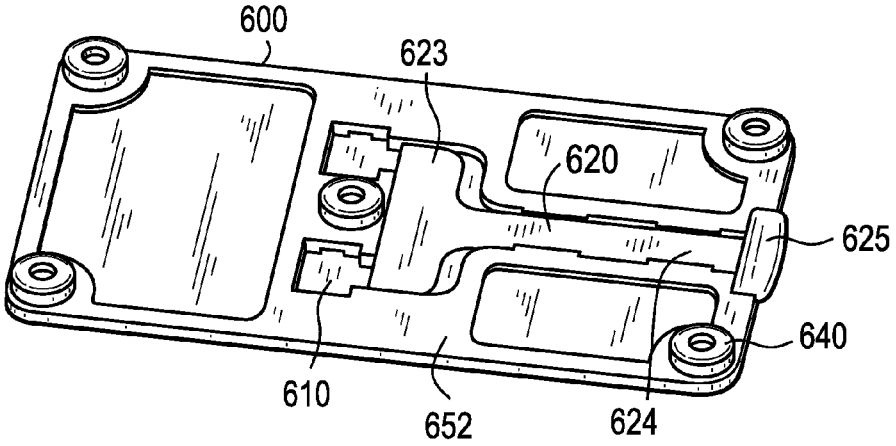
FIG. 8A is a perspective view of a cover plate including a slide, according to an exemplary embodiment.

FIG. 8A is a perspective view of a cover plate 600 to which the plug 100 is attachable, according to an exemplary embodiment. The cover plate 600 may be made of plastic or other material as needed to provide the desired shape and structure of the assembly. Alternately, the cover plate 600 may be made of metal. The cover plate 600 includes one or more openings 610 therein, which are configured to allow the plug 100 to extend therethrough from a rear side 652 to a front side 651 of the cover plate 600. The cover plate 600 also may include a slide 620, extending substantially parallel to the plane of the cover plate 600, and having a first end 621 that is adjacent to the openings 610 and may be straight or paddle-shaped, and a second end 622 that is in contact with a button 625, located at an end of the cover plate 600. Alternately, the second end 622 and the button 625 may be integrally formed. The slide 620 may be made of the same material as that of the cover plate 600. The cover plate 600 may include one or more bosses 640, disposed in locations corresponding to the holes 563 in the circuit board 500 such as the corners of the cover plate 600. The bosses 640 may be integrally formed with the cover plate or may be attached thereto, as would be understood by one of skill in the art. In this way, the cover plate 600 may be connected to the circuit board 500 by one or more screws or other connectors extending through the bosses 640 on the cover plate 600 and the holes 563 in the circuit board 500. Alternatively, the cover plate 600 and the circuit board 500 may be connectable in a different manner without use of the bosses 640.

Figure 7A:
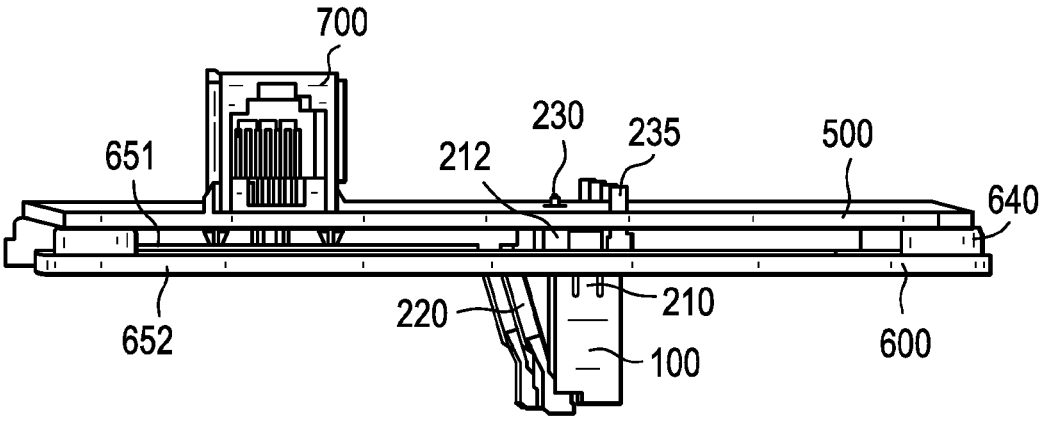
FIGS. 7A and 7B are a side view and an end view, respectively, of a plug attached to a circuit board and a cover plate, according to an exemplary embodiment.
Figure 7B:
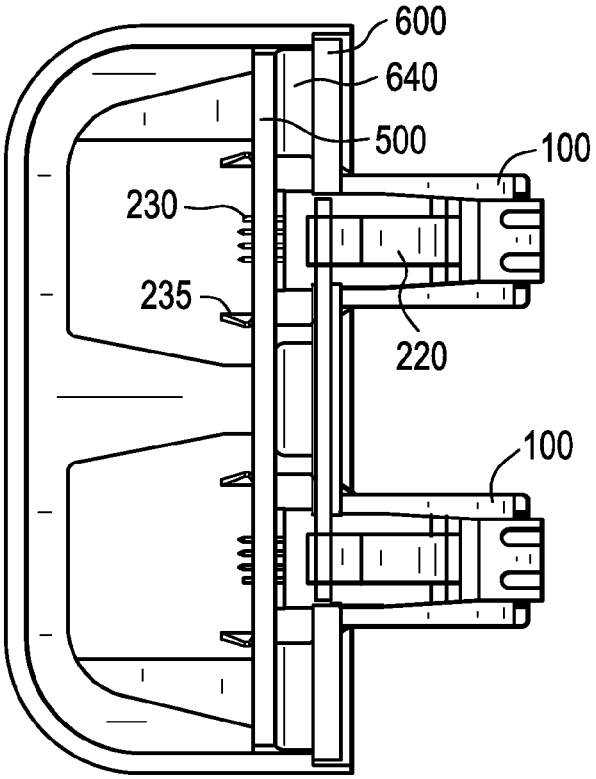

As shown in FIGS. 7A and 7B, when the plug 100 is connected to the circuit board 500, the board interface 300 may also extend through the cover plate 600 disposed on a rear side of the circuit board 500. When connected as shown, the front edge 212 of each of the snaps 210 presses on the rear side 652 of the cover plate 600, and the standoffs 217 are disposed between the front side 651 of the cover plate 600 and the rear side 552 of the circuit board 500, maintaining a spacing between the cover plate 600 and the circuit board 500 and holding the plug 100 to the cover plate 600. It is this spacing between the cover plate 600 and the circuit board 500 which enables other devices, such as the jack 700, to be connected to the circuit board 500, with their pins and tabs extending through the circuit board 500 to the rear side of the circuit board 552. While the snaps 210 and standoffs 217 are shown in the figures and described herein, the plug 100 may alternately be connectable to the cover plate in another manner which enables a secure attachment therebetween.

The snap release 220 of the plug 100 may be long enough to extend at least partly through the cover plate 600, and the opening 610 in the cover plate 600 may be large enough and/or shaped in a configuration that allows the snap release 200 to extend therethrough, as shown in FIG. 7A, when the plug 100 is connected to the cover plate 600. Alternately, the snap release 220 may be shorter and not extend at all into the opening 610 in the cover plate 600.

With the snap release 220 extending at least partly through the opening 610 in the cover plate 600, the cover plate may include a slide 620 and a button 625 to enable the snap release 220 to be pressed and engaged. FIGS. 8A, 8B, 8C, and 8D illustrate the cover plate 600 including the slide 620 and button 625. The slide 620 and the button 625 may be made of the same material as that of the cover plate. As shown in FIG. 8D, the slide 620 and button 625 may be separable from the rest of the cover plate 600, and may be installed therewith. When the slide 620 is attached to the rest of the cover plate 600, it is slidable with respect to the rest of the cover plate 600 in a direction substantially parallel to the plane of the cover plate 600, in a direction as shown by the arrows in FIGS. 8B and 8C. The slide 620 may include a first portion 623 which may be at least as wide as required to extend laterally (in a direction perpendicular to the arrows in FIGS. 8B and 8C) into each of the openings 610. The slide 620 may also include an extended second portion 624 which is narrower than the first portion and which extends from the first portion to the button 625, disposed at an end of the cover plate 600. While this specific configuration is shown and described, the slide may have any other configuration provided that it extends into at least one of the openings 610 and, from there, extends to the button 625, disposed at an end of the cover plate 600.

Figure 8B:
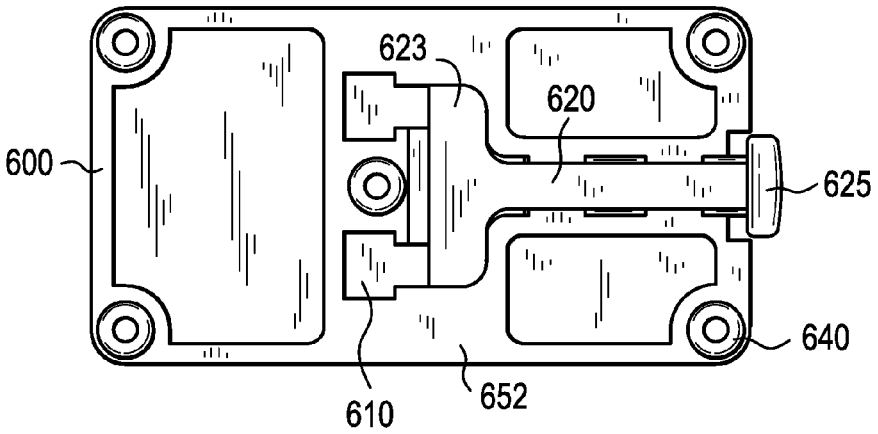
FIGS. 8B and 8C are rear side views of the cover plate of FIG. 8A.
Figure 8C:
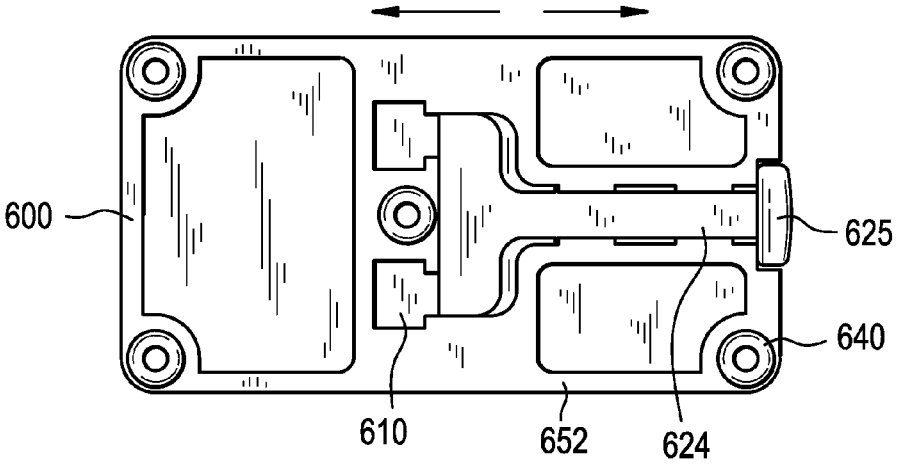
Figure 8D:
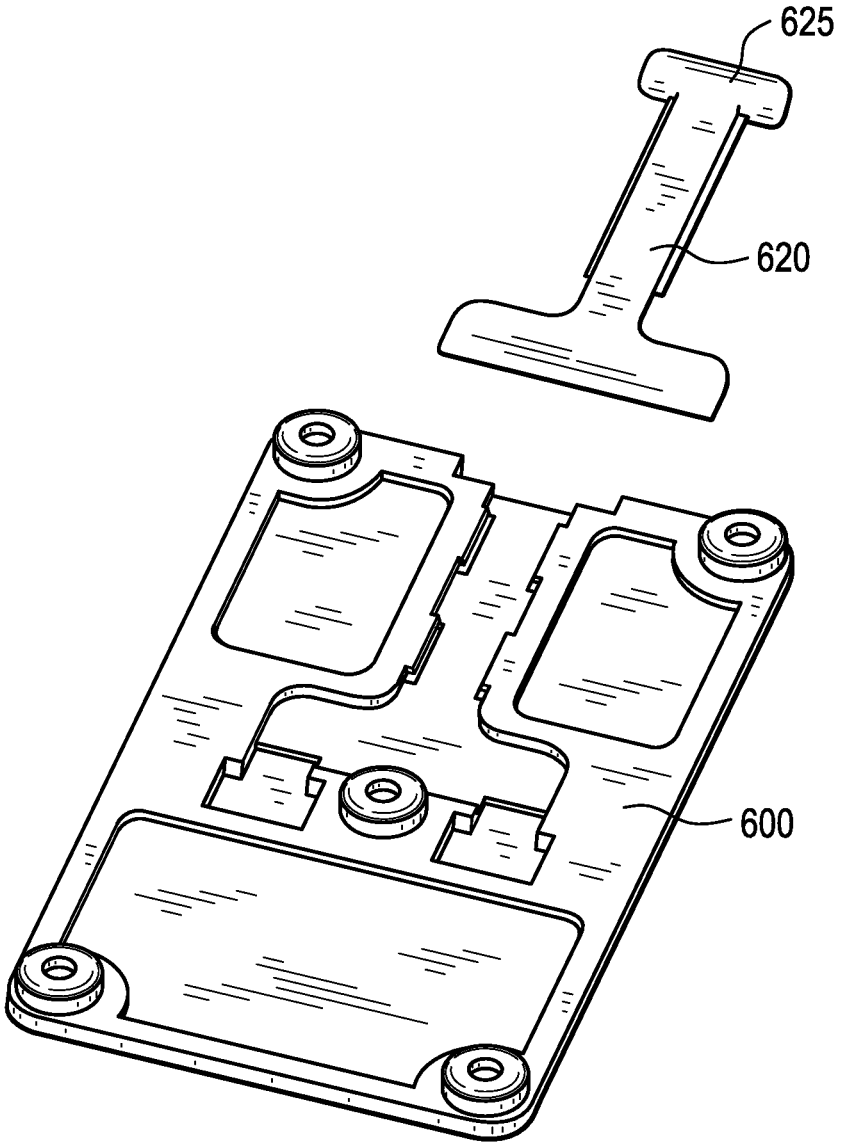
FIG. 8D is a perspective view of the cover plate and slide with the slide removed from the cover plate, according to an exemplary embodiment.

FIG. 8B shows the slide in a position which allows the plug 100 to extend through the opening 610 with the snap release 220 in an extended position. FIG. 8C shows the slide in a position in which it has been pressed toward the opening 610 by a force exerted on the button 625, such that the first end 621 of the slide 620 is in a position to press and engage the snap release 220 of a plug 100 extending through the opening 610 in the cover plate 600.

Figure 9A:
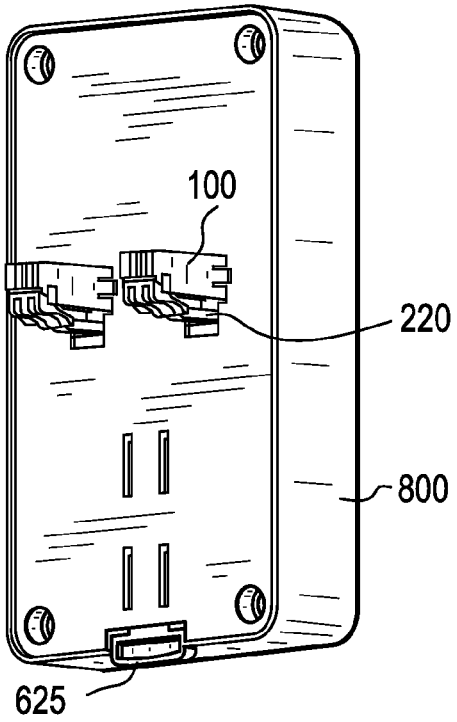
FIGS. 9A and 9B are perspective views of two plugs mounted to a cover plate and circuit board, according to an exemplary embodiment.
Figure 9B:
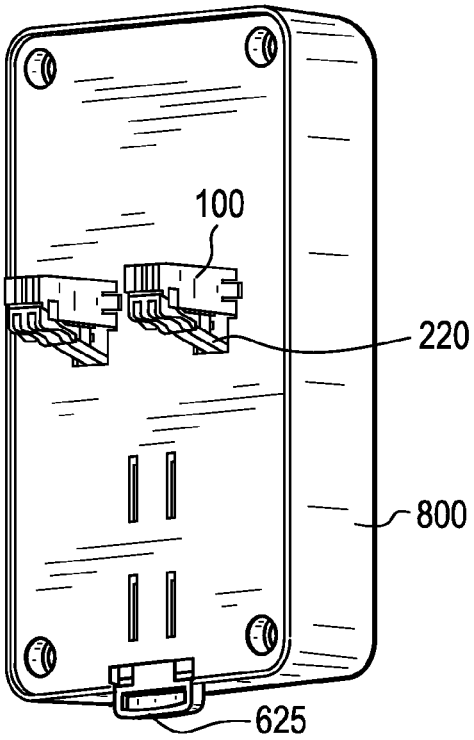

FIGS. 9A and 9B are perspective views of the rear side of the cover plate 600 with plugs 100 extending therethrough. FIG. 9B illustrates the button in a position which is not pressed, such that the snap release 220 of the plugs 100 are in extended positions. FIG. 9A illustrates the button in a pressed position in which the force on the button 625 causes the slide 620 to press into the openings 610 and on the snap releases 220 of the plugs 100 to engage the snap releases 220.

FIGS. 9A and 9B also illustrate a main cover 800 which may be connected to an outer periphery of the cover plate 600 and cover the front side 551 of the circuit board 500. The main cover 800 may be made of the same material as that of the cover plate 600.

A plug, as described herein with respect to exemplary embodiments, and its connection to a circuit board may provide improved stability for the connection between an RJ jack and a circuit board, as well as a more compact shape that can be installed without tools. The plug can be particularly useful when connected to a PCB used in a telecom device such as a router, an optical network terminal (ONT), a telephone, a modem, an alarm system, or an Asymmetric digital subscriber line (ADSL) splitter.

It should be understood that exemplary embodiments described herein should be considered in a descriptive sense only and not for purposes of limitation. Descriptions of features or aspects within each embodiment should typically be considered as available for other similar features or aspects in other embodiments.

While one or more exemplary embodiments have been described with reference to the figures, it will be understood by those of ordinary skill in the art that various changes in form and details may be made therein without departing from the spirit and scope of the present inventive concept as defined by the following claims.

The invention claimed is:

1. A plug, configured to be mountable to a circuit board, the plug comprising:

a mounting interface, disposed at a rear end of the plug and configured to be attachable to a registered jack-style jack; and a board interface, disposed at a front end of the plug, the front end and rear end spaced apart along a lengthwise longitudinal axis of the plug, wherein the board interface comprises:

at least one pin contact which extends longitudinally outward from the front end of the plug, wherein each of the at least one pin contacts is electrically-conductive and electrically connected to a spade which extends within the plug from the pin contact to the rear end of the plug; and a first tab extending longitudinally and transversely outward from the front end of the plug and a second tab extending longitudinally and transversely outward from the front end of the plug, wherein each of the first tab and the second tab is configured to extend through a circuit board from a second side thereof to a first side thereof, and to clasp the first side of the circuit board.

2. The plug according to claim 1, wherein the board interface further comprises:

a first snap protruding from a first side of the plug and a second snap protruding from a second side of the plug, opposite the first side; and at least one first stand-off, protruding transversely from the first side of the plug, and at least one second stand-off protruding transversely from the second side of the plug;

wherein the first snap and the at least one first standoff are configured to grasp a cover plate therebetween, and the second snap and the at least one second standoff are configured to grasp the cover plate therebetween.

3. The plug according to claim 2, wherein the at least one first stand-off and the at least one second stand-off further extend longitudinally outward from the front end.

4. The plug according to claim 2, wherein the first snap and the second snap each taper in a direction from the front end towards the rear end.

5. The plug according to claim 1, further comprising a snap release.

6. An assembly comprising:

a circuit board; and a plug mountable to the circuit board, the plug comprising:

a mounting interface disposed at a rear end of the plug; and a board interface disposed at a front end of the plug, the front end and rear end spaced apart along a lengthwise longitudinal axis of the plug, wherein the board interface comprises:

at least one pin contact which extends longitudinally outward from the front end of the plug, wherein each of the at least one pin contacts is electrically-conductive and electrically connected to a spade which extends within the plug from the pin contact to the rear end of the plug; and a first tab extending longitudinally and transversely outward from the front end of the plug and a second tab extending longitudinally and transversely outward from the front end of the plug, wherein each of the first tab and the second tab is configured to extend through a circuit board from a second side thereof to a first side thereof, and to clasp the first side of the circuit board.

7. The assembly of claim 6, further comprising a cover plate, the cover plate defining an opening through which the plug is extendable.

8. The assembly of claim 7, wherein the cover plate comprises a slide.

* * * * *